US009506126B2

(12) United States Patent
Ueyama

(10) Patent No.: US 9,506,126 B2
(45) Date of Patent: Nov. 29, 2016

(54) AUSTENITIC STAINLESS STEEL AND METHOD FOR PRODUCING AUSTENITIC STAINLESS STEEL MATERIAL

(75) Inventor: Masaki Ueyama, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 296 days.

(21) Appl. No.: 14/128,777

(22) PCT Filed: Jun. 20, 2012

(86) PCT No.: PCT/JP2012/065733
§ 371 (c)(1),
(2), (4) Date: Dec. 23, 2013

(87) PCT Pub. No.: WO2012/176802
PCT Pub. Date: Dec. 27, 2012

(65) Prior Publication Data

US 2014/0137994 A1 May 22, 2014

(30) Foreign Application Priority Data

Jun. 24, 2011 (JP) ..... 2011-140283

(51) Int. Cl.

| | |
|---|---|
| ***C22C 38/58*** | (2006.01) |
| ***C21D 8/00*** | (2006.01) |
| ***C21D 6/00*** | (2006.01) |
| ***C22C 30/00*** | (2006.01) |
| ***C22C 38/00*** | (2006.01) |
| ***C22C 38/02*** | (2006.01) |
| ***C22C 38/44*** | (2006.01) |

(52) U.S. Cl.
CPC ..... *C21D 8/005* (2013.01); *C21D 6/004* (2013.01); *C22C 30/00* (2013.01); *C22C 38/001* (2013.01); *C22C 38/002* (2013.01); *C22C 38/004* (2013.01); *C22C 38/005* (2013.01); *C22C 38/02* (2013.01); *C22C 38/44* (2013.01); *C22C 38/58* (2013.01)

(58) Field of Classification Search
CPC ..... C22C 38/52; C22C 38/58
USPC ..... 148/327, 442, 608, 707; 420/44, 46, 52
See application file for complete search history.

(56) References Cited

U.S. PATENT DOCUMENTS

2006/0243356 A1 11/2006 Oikawa et al.

FOREIGN PATENT DOCUMENTS

| | | |
|---|---|---|
| JP | 06-256911 | 9/1994 |
| JP | 09-184013 | 7/1997 |
| JP | 10-88289 | 4/1998 |
| JP | 2005-509751 | 4/2005 |
| JP | 2008-019479 | 1/2008 |
| JP | 2009-068079 | 4/2009 |

OTHER PUBLICATIONS

Gulyaev A.P., "Metal Technology, M.: "Metallurgy"", 1986, p. 322.
"Sandvik 2RE69", In: Ed. J.R. Davis: "Alloy™ Digest Sourcebook Stainless Steels", pp. 61-62, Apr. 1989.
Kvarnbaeck, Bengt: "2RE69 and 3R60 Urea Grade . . . Urea Plant Corrosion", Chemical Age of India, pp. 337-342, vol. 25, No. 5, May 1974.

*Primary Examiner* — Brian Walck
(74) *Attorney, Agent, or Firm* — Clark & Brody

(57) ABSTRACT

Austenitic stainless steel having high temperature strength and excellent nitric acid corrosion resistance is provided. The austenitic stainless steel according to the present embodiment including, in mass percent, C: at most 0.050%, Si: 0.01 to 1.00%, Mn: 1.75 to 2.50%, P: at most 0.050%, S: at most 0.0100%, Ni: 20.00 to 24.00%, Cr: 23.00 to 27.00%, Mo: 1.80 to 3.20%, and N: 0.110 to 0.180%, the balance being Fe and impurities, a grain size number of crystal grains based on JIS G0551 (2005) is at least 6.0, and an area fraction of a σ phase is at most 0.1%.

2 Claims, No Drawings

AUSTENITIC STAINLESS STEEL AND METHOD FOR PRODUCING AUSTENITIC STAINLESS STEEL MATERIAL

TECHNICAL FIELD

The present invention relates to austenitic stainless steel and a method for producing an austenitic stainless steel material, and more particularly to austenitic stainless steel used in a corrosive environment of a chemical plant or the like, and a method for producing an austenitic stainless steel material.

BACKGROUND ART

A steel material used in a chemical plant is required to have excellent corrosion resistance as well as strength. In particular, in a urea plant that is one of chemical plants, high temperature strength and nitric acid corrosion resistance are required. In a urea plant, urea is generally produced by the following method. A gaseous mixture containing ammonia and carbon dioxide is condensed through a high pressure of 130 kg/cm$^2$ or higher in a high temperature range of 160 to 230° C. At this time, urea is produced by synthesis reaction. Since urea is produced under a high temperature and high pressure as described above, the steel materials used in urea plants are required to have excellent high temperature strength.

In the production process of urea described above, an intermediate product called ammonium carbamate is further produced. Corrosiveness of ammonium carbamate is very strong. It is generally known that corrosion by ammonium carbamate is correlated with corrosion by nitric acid. Accordingly, steel materials for urea plants are required to have not only high temperature strength but also excellent nitric acid corrosion resistance.

Austenitic stainless steel typified by SUS316, SUS317 and the like in JIS Standard has excellent corrosion resistance. Therefore, these types of austenitic stainless steel are used as steel materials for plants.

With the objective of further improving the strength and corrosion resistance of the austenitic stainless steel as above, the following arts are proposed.

JP10-88289A (Patent Document 1) proposes Cr—Mn austenitic steel excellent in strength and corrosion resistance. In Patent Document 1, the crystal grains of Cr—Mn austenitic steel are ultra-refined, and the average grain size is 1 μm or less. Patent Document 1 indicates that thereby, Cr—Mn austenitic steel having high strength and excellent corrosion resistance is obtained.

JP6-256911A (Patent Document 2) proposes austenitic stainless steel having excellent nitric acid corrosion resistance even after cold working. In Patent Document 2, Ni, Mn, C, N, Si and Cr contents in the steel are controlled. Patent Document 2 indicates that thereby, martensite production by strain induced transformation after cold working is suppressed, and excellent nitric acid corrosion resistance is obtained.

JP2005-509751A (Patent Document 3) proposes ultra austenitic stainless steel having excellent corrosion resistance. In Patent Document 3, Cu is contained as well as Cr, Ni, Mo and Mn. Patent Document 3 indicates that by containing right amounts of these elements, excellent corrosion resistance is obtained.

However, the austenitic stainless steel disclosed in each of Patent Documents 1 to 3 sometimes cannot provide sufficient high temperature strength while maintaining nitric acid corrosion resistance.

DISCLOSURE OF THE INVENTION

An objective of the present invention is to provide austenitic stainless steel having high temperature strength and excellent nitric acid corrosion resistance.

Austenitic stainless steel according to the present invention comprising, in mass percent, C: at most 0.050%, Si: 0.01 to 1.00%, Mn: 1.75 to 2.50%, P: at most 0.050%, S: at most 0.0100%, Ni: 20.00 to 24.00%, Cr: 23.00 to 27.00%, Mo: 1.80 to 3.20%, and N: 0.110 to 0.180%, the balance being Fe and impurities, wherein a grain size number of crystal grains based on JIS G0551 (2005) is at least 6.0, and an area fraction of a σ phase in the steel is at most 0.1%.

The austenitic stainless steel according to the present invention has higher temperature strength and excellent nitric acid corrosion resistance.

The austenitic stainless steel according to the present invention may further comprising, in place of some of the Fe, one or two types selected from a group consisting of Ca: at most 0.0100%, Mg: at most 0.0100%, and rare earth metal (REM): at most 0.200%.

The method for producing an austenitic stainless steel material according to the present invention includes a step of preparing a starting material comprising, in mass percent, C: at most 0.050%, Si: 0.01 to 1.00%, Mn: 1.75 to 2.50%, P: at most 0.050%, S: at most 0.0100%, Ni: 20.00 to 24.00%, Cr: 23.00 to 27.00%, Mo: 1.80 to 3.20%, and N: 0.110 to 0.180%, the balance being Fe and impurities, a step of subjecting the starting material to hot working to produce a steel material, and a step of carrying out solution treatment at a solution temperature of 1050 to 1100° C., for the steel material.

The austenitic stainless steel material produced by the production method according to the present invention has higher temperature strength, and excellent nitric acid corrosion resistance.

BEST MODE FOR CARRYING OUT THE INVENTION

Hereinafter, an embodiment of the present invention will be described in detail. In the following description, "%" of contents of elements means mass percent.

The present inventor made a study concerning high temperature strength and nitric acid corrosion resistance of austenitic stainless steel. As a result, the present inventor obtained the following finding.

(A) In order to obtain higher temperature strength, 1.75% or more of Mn is contained. Mn is dissolved in steel, and enhances the high temperature strength of the steel. Further, even if Mn is contained, the nitric acid corrosion resistance of the steel is less likely to be reduced. Accordingly, in order to obtain higher temperature strength and excellent nitric acid corrosion resistance, Mn is effective.

(B) If crystal grains are refined, the high temperature strength and the nitric acid corrosion resistance of austenitic stainless steel are enhanced. More specifically, if the grain size number of crystal grains based on JIS G0551 (2005) is 6.0 or larger, excellent high temperature strength and nitric acid corrosion resistance are obtained. Note that in the present description, a revision year is written in the parentheses written at the end of JIS Standard.

(C) A sigma phase (hereinafter, called a σ phase) reduces nitric acid corrosion resistance. Accordingly, in order to obtain excellent nitric acid corrosion resistance, production of σ phases has to be suppressed. Cr and Mo are dissolved in steel to enhance the high temperature strength of the steel similarly to Mn. However, Cr and Mo promote production of σ phases. Accordingly, in the present invention, a Cr content and an Mo content are suppressed. More specifically, an upper limit of the Cr content is set to be 27.00%, and an upper limit of the Mo content is set to be 3.20%.

(D) In order to suppress production of σ phases, and to obtain higher temperature strength, a solution temperature in solution treatment is set to be 1050 to 1100° C. If the solution temperature is lower than 1050° C., σ phases are produced. More specifically, an area fraction of the σ phases in the steel exceeds 0.1%. As a result, the nitric acid corrosion resistance is reduced. On the other hand, if the solution temperature exceeds 1100° C., the high temperature strength is reduced. If a chemical composition is adjusted based on the above described (A) and (C), and the solution temperature is set to be 1050 to 1100° C., the high temperature strength and the nitric acid corrosion resistance of the produced austenitic stainless steel are enhanced. More specifically, yield strength at 230° C. becomes 220 MPa or more, and a corrosion rate in a 65% nitric acid corrosion test in conformity to JIS G0573 (1999) becomes 0.085 $g/m^2/h$ or less.

Based on the above finding, the present inventor completed the present invention. Hereinafter, austenitic stainless steel according to the present invention will be described.

[Chemical Composition]

The austenitic stainless steel according to the present invention has the following chemical composition.

C: at most 0.050%

Carbon (C) combines with Cr to form a Cr carbide. Cr carbides are precipitated on grain boundaries, and enhance high temperature strength of steel. Meanwhile, if C is excessively contained, a Cr depleted zone is formed in the vicinity of the grain boundaries. The Cr depleted zone reduces nitric acid corrosion resistance of steel. Accordingly, a C content is at most 0.050%. A lower limit of the C content is not especially set, and if the C content is 0.002% or more, the above described effect is remarkably obtained. An upper limit of the C content is preferably less than 0.050%, and more preferably is 0.030%. A far more preferable lower limit of the C content is 0.010%.

Si: 0.01 to 1.00%

Silicon (Si) deoxidizes steel. Si further enhances oxidation resistance of steel. Meanwhile, if Si is excessively contained, Si segregates on grain boundaries. The segregated Si reacts with a combusted slug containing chlorides, and thereby, intergranular corrosion occurs. If Si is excessively contained, the mechanical properties such as ductility of the steel are further reduced. Accordingly, an Si content is 0.01 to 1.00%. A lower limit of the Si content is preferably higher than 0.01%, more preferably is 0.10%, and far more preferably is 0.20%. An upper limit of the Si content is preferably less than 1.00%, is more preferably 0.40%, and is far more preferably 0.30%.

Mn: 1.75 to 2.50%

Manganese (Mn) is dissolved in steel, and enhances high temperature strength of the steel. Further, even if Mn is contained, the nitric acid corrosion resistance of the steel is less likely to be reduced. Accordingly, Mn is effective in enhancing high temperature strength while maintaining the nitric acid corrosion resistance of the steel. Mn further deoxidizes steel. Further, Mn is an austenite forming element, and stabilizes austenite phases in a matrix. Mn further combines with S in steel to form MnS and enhances hot workability of the steel. Meanwhile, if Mn is excessively contained, workability and weldability of the steel are reduced. Accordingly, an Mn content is 1.75 to 2.50%. A lower limit of the Mn content is preferably higher than 1.75%, is more preferably 1.85%, and is far more preferably 1.90%. An upper limit of the Mn content is preferably less than 2.50%, is more preferably 2.30%, and is far more preferably 2.00%.

P: at most 0.050%

Phosphorus (P) is an impurity. P reduces weldability and workability of steel. Accordingly, the smaller the P content, the better. The P content is at most 0.050%. An upper limit of the P content is preferably less than 0.050%, is more preferably at most 0.020%, and is far more preferably at most 0.015%.

S: at most 0.0100%

(Sulfur) S is an impurity. S reduces weldability and workability of steel. Accordingly, the smaller the S content, the better. The S content is at most 0.0100%. An upper limit of the S content is preferably lower than 0.0100%, is more preferably 0.0020%, and is far more preferably 0.0012%.

Ni: 20.00 to 24.00%

Nickel (Ni) is an austenite forming element, and stabilizes austenite phases in a matrix. Ni further enhances high temperature strength and nitric acid corrosion resistance of steel. Meanwhile, if Ni is excessively contained, a dissolution limit of N decreases to reduce the nitric acid corrosion resistance of the steel on the contrary due to reduction in strength and precipitation of nitrides. Accordingly, an Ni content is 20.00 to 24.00%. A lower limit of the Ni content is preferably higher than 20.00%, is more preferably 21.00%, and is far more preferably 22.00%. An upper limit of the Ni content is preferably less than 24.00%, is more preferably 23.00%, and is far more preferably 22.75%.

Cr: 23.00 to 27.00%

Chrome (Cr) enhances nitric acid corrosion resistance of steel. Further, Cr is dissolved in steel to enhance high temperature strength of the steel. Meanwhile, if Cr is excessively contained, σ phases are precipitated in the steel, and the nitric acid corrosion resistance of the steel is reduced. The σ phase further reduces weldability and workability of the steel. Accordingly, a Cr content is 23.00 to 27.00%. A lower limit of the Cr content is preferably higher than 23.00%, is more preferably 24.00%, and is far more preferably 24.50%. An upper limit of the Cr content is preferably less than 27.00%, is more preferably 26.00%, and is far more preferably 25.50%.

Mo: 1.80 to 3.20%

Molybdenum (Mo) enhances nitric acid corrosion resistance of steel. Further, Mo is dissolved in steel to enhance high temperature strength of the steel. Meanwhile, if Mo is excessively contained, σ phases are precipitated in the steel, and nitric acid corrosion resistance of the steel is reduced. The σ phase further reduces weldability and workability of the steel. Accordingly, an Mo content is 1.80 to 3.20%. A lower limit of the Mo content is preferably higher than 1.80%, is more preferably 1.90%, and is far more preferably 2.00%. An upper limit of the Mo content is preferably less than 3.20%, is more preferably 2.80%, and is far more preferably 2.50%.

N: 0.110 to 0.180%

Nitrogen (N) is an austenite forming element, and stabilizes austenite phases in a matrix. Nitrogen further forms fine nitrides to refine crystal grains, and enhances high temperature strength of steel. Further, nitrogen also has an effect of stabilizing a surface film, and enhances nitric acid corrosion resistance. Meanwhile, if N is excessively contained, nitrides are excessively produced, whereby hot workability of steel is reduced, and nitric acid corrosion resistance is further reduced. Accordingly, an N content is 0.110 to 0.180%. A lower limit of the N content is preferably higher than 0.110%, is more preferably 0.120%, and is far more preferably 0.130%. An upper limit of the N content is preferably less than 0.180%, is more preferably 0.170%, and is far more preferably 0.160%.

The balance of the austenitic stainless steel according to the present invention is Fe and impurities. Impurities refer to elements that enter from ores and scraps that are used as raw materials of the steel, the environment of a production process, or the like.

[Grain Size]

In the austenitic stainless steel according to the present invention, the grain size number of the crystal grains as measured by being corroded with use of about 20% of a nitric acid aqueous solution based on JIS G0551 (2005) is 6.0 or larger. If the grain size number is 6.0 or larger, the austenitic stainless steel has excellent high temperature strength while maintaining nitric acid corrosion resistance.

[Sigma Phase Area Fraction]

In the austenitic stainless steel according to the present invention, an area fraction of a sigma phase (hereinafter, called a σ phase) in the steel is at most 0.1%. Here, the area fraction of the σ phase is calculated by the following method.

A sample for microscopic observation is extracted from an arbitrary spot of an austenitic stainless steel material. A surface of the extracted sample is mechanically polished, and etched. In the etched sample surface, arbitrary six visual fields are observed with use of a 400-power lens including 20 by 20, 400 lattices in total with an optical microscope. An observation region of each of the visual fields is 225 $\mu m^2$. The number of σ phases existing on the lattice points in each of the visual fields is counted, and a value obtained by dividing the number of σ phases existing on the lattice points in the visual fields by a total number of lattice points of the six visual fields (2400 points) is defined as an area fraction of the σ phase (in %).

In the present invention, the area fraction of the u phase in the steel is at most 0.1%. Therefore, the austenitic stainless steel according to the present invention has excellent nitric acid corrosion resistance. When the steel having the aforementioned chemical composition is produced by a production method that will be described later, the area fraction of the σ phase becomes at most 0.1%. An area fraction of the σ phase is preferably less than 0.05%, and is more preferably at most 0.01%.

The austenitic stainless steel of the present invention having the above composition has excellent high temperature strength and nitric acid corrosion resistance. More specifically, the high temperature strength at 230° C. of the austenitic stainless steel according to the present invention is 220 MPa or more. Yield strength mentioned here is defined as 0.2% yield stress. Further, the corrosion rate that is obtained by the 65% nitric acid corrosion test (Huey test) in conformity with JIS G0573 (1999) is at most 0.085 $g/m^2/h$.

A total content of C and N is preferably 0.145% or more in the aforementioned chemical composition. In this case, high temperature strength of the austenitic stainless steel is further enhanced.

[Selective Element]

The austenitic stainless steel according to the present invention further contains one or more types selected from a group consisting of Ca, Mg and rare earth metal (REM). All of these elements enhance hot workability of steel.

Ca at most 0.0100%

Calcium (Ca) is a selective element. Ca enhances hot workablity of steel. Meanwhile, if Ca is excessively contained, cleanliness of steel is reduced. Therefore, nitric acid corrosion resistance and toughness of the steel are reduced, and mechanical properties of the steel are reduced. Accordingly, a Ca content is at most 0.0100%. If the Ca content is 0.0005% or more, the above described effect is remarkably obtained. An upper limit of the Ca content is preferably less than 0.0100%, and is more preferably 0.0050%.

Mg: at most 0.0100%

Magnesium (Mg) is a selective element. Mg enhances hot workability of steel. Meanwhile, if Mg is excessively contained, cleanliness of the steel is reduced. Therefore, nitric acid corrosion resistance and toughness of the steel are reduced, and mechanical properties of the steel are reduced. Accordingly, an Mg content is at most 0.0100%. If the Mg content is 0.0005% or more, the above described effect is remarkably obtained. An upper limit of the Mg content is preferably less than 0.0100%, and is more preferably 0.0050%.

Rare earth metal (REM): at most 0.200%

Rare earth metal (REM) is a selective element. REM has a high affinity for S. Therefore, REM enhances hot workability of steel. However, if REM is excessively contained, cleanliness of the steel is reduced. Therefore, nitric acid corrosion resistance and toughness of the steel are reduced, and mechanical properties of the steel are reduced. Accordingly, an REM content is at most 0.200%. If the REM content is 0.001% or more, the above described effect is remarkably obtained. An upper limit of the REM content is preferably less than 0.150%, and is more preferably 0.100%.

REM is a generic name of 17 elements that are lanthanum (La) of atomic number 57 to lutetium (Lu) of atomic number 71 in the periodic table, to which yttrium (Y) and scandium (Sc) are added. The content of REM means a total content of one or more types of these elements.

When two types or more of Ca, Mg and REM are contained, the total content of Ca, Mg and REM is preferably at most 0.0150%. In this case, excellent hot workability is obtained while nitric acid corrosion resistance of steel is maintained.

[Production Method]

An example of a method for producing an austenitic stainless steel material according to the present invention will be described.

Molten steel having the aforementioned chemical composition is produced by blast furnace or electric furnace melting. Well-known degassing treatment is applied to the produced molten steel as necessary.

Next, a starting material is produced from the molten steel. More specifically, the molten steel is formed into casting materials by a continuous casting process. Casting materials are, for example, slabs, blooms and billets. Alternatively, the molten steel is formed into ingots by an ingot-making process. The starting material mentioned in the present description is, for example, the aforementioned casting material or ingot. Next, the produced starting material (the casting material or ingot) is subjected to hot working by a well-known method, and formed into an austenitic stainless steel material. Examples of the austenitic stainless steel material include steel pipes (seamless pipes or welded steel pipes), steel plates, steel bars, wire rods, forged steel and the like. Hot working is, for example, piercing-roll, hot rolling, hot forging or the like. For the austenitic stainless steel material after hot working, cold working such as cold rolling and cold draw may be carried out.

Solution treatment is carried out for the produced austenitic stainless steel material. The temperature of the solution treatment (solution temperature) is 1050 to 1100° C. If the solution temperature is less than 1050° C., σ phases are produced, and the area fraction of the u phase in the steel exceeds 0.1%. Meanwhile, if the solution temperature exceeds 1100° C., the crystal grains are coarsened, and the grain size number becomes smaller than 6.0. If the solution temperature is 1050 to 1100° C., the grain size number of the crystal grains is 6.0 or larger, and the area fraction of the σ phase becomes at most 0.1%.

A preferable holding (soaking) time period at the solution temperature is one minute to ten minutes. An upper limit of the soaking time period is preferably five minutes. In the solution treatment, the steel is held at the solution temperature for a predetermined time period, and thereafter, is rapidly cooled.

In the above process, the austenitic stainless steel according to the present invention is produced.

EXAMPLE

A plurality of types of austenitic stainless steel materials were produced, and the high temperature strength and the nitric acid corrosion resistance of each of the steel materials were examined.

[Examination Method]

The austenitic stainless steel of each of mark 1 to mark 12 having the chemical composition shown in Table 1 was melted in a high-frequency heating vacuum furnace to produce ingots.

TABLE 1

| | Chemical composition (in mass %, balance being Fe and impurities) | | | | | | | | | | | Solution temperature |
|---|---|---|---|---|---|---|---|---|---|---|---|---|
| Mark | C | Si | Mn | P | S | Ni | Cr | Mo | N | Ca | REM (Nd) | (° C.) |
| 1 | 0.010 | 0.21 | 1.87 | 0.013 | 0.0010 | 22.30 | 24.72 | 2.09 | 0.155 | — | — | 1080 |
| 2 | 0.010 | 0.21 | 1.93 | 0.014 | 0.0009 | 22.64 | 24.52 | 2.17 | 0.158 | 0.0015 | — | 1080 |
| 3 | 0.012 | 0.29 | 1.99 | 0.019 | 0.0009 | 22.89 | 25.12 | 2.39 | 0.156 | — | 0.042 | 1090 |
| 4 | 0.010 | 0.20 | 1.74 | 0.014 | 0.0008 | 22.22 | 24.56 | 2.10 | 0.133 | — | — | 1120 |
| 5 | 0.006 | 0.24 | 1.53 | 0.019 | 0.0002 | 21.88 | 24.88 | 2.12 | 0.159 | — | — | 1080 |
| 6 | 0.010 | 0.23 | 1.86 | 0.017 | 0.0003 | 21.94 | 25.05 | 2.11 | 0.126 | 0.0018 | — | 1120 |
| 7 | 0.009 | 0.22 | 1.81 | 0.019 | 0.0011 | 21.96 | 24.95 | 2.11 | 0.151 | 0.0009 | — | 1030 |
| 8 | 0.011 | 0.20 | 1.81 | 0.018 | 0.0014 | 19.71 | 25.10 | 2.23 | 0.119 | — | — | 1050 |
| 9 | 0.013 | 0.19 | 1.78 | 0.018 | 0.0019 | 25.12 | 25.14 | 2.19 | 0.129 | 0.0009 | — | 1080 |
| 10 | 0.008 | 0.21 | 1.76 | 0.016 | 0.0012 | 23.12 | 25.03 | 2.09 | 0.098 | 0.0009 | — | 1080 |
| 11 | 0.015 | 0.18 | 1.83 | 0.018 | 0.0009 | 20.91 | 25.07 | 2.35 | 0.212 | 0.0017 | — | 1080 |
| 12 | 0.011 | 0.22 | 1.79 | 0.018 | 0.0007 | 21.89 | 24.87 | 2.09 | 0.144 | 0.0011 | — | 1000 |

In each of the columns of the symbols of the respective elements (C, Si, Mn, P, S, Ni, Cr, Mo, N, Ca, REM) in Table 1, the content (mass %) of the corresponding element in the steel of each of the marks is written. The balance except for the elements described in Table 1 of the chemical composition of each of the marks is Fe and impurities. In Table 1, "-" indicates that the corresponding element content is at an impurity level.

The chemical compositions of marks 1 to 3, 6, 7 and 12 were within the range of the present invention. Meanwhile, the Mn contents of marks 4 and 5 were less than the lower limit of the Mn content of the present invention. The Ni content of mark 8 was less than the lower limit of the Ni content of the present invention, and the Ni content of mark 9 exceeded the upper limit of the Ni content of the present invention. The lower limit of the N content of mark 10 was less than the lower limit of the N content of the present invention, and the N content of mark 11 exceeded the upper limit of the N content of the present invention.

The respective produced ingots were subjected to hot forging, and hot-rolling to produce an intermediate material. Further, the intermediate material was subjected to cold rolling to produce austenitic stainless steel plates of a thickness of 30 mm.

For the produced steel plates, solution treatment was carried out at the solution temperatures shown in Table 1. The holding time periods at the solution temperatures were three minutes in all the marks. After a lapse of the holding time period, the steel plates were rapidly cooled (water-cooled).

[σ Phase Area Fraction]

From arbitrary spots of the produced steel plates of the respective marks, samples for microscopic test observation were extracted. The surfaces of the extracted samples were mechanically polished, and etched. In the etched sample surfaces, arbitrary six visual fields were observed with use of a 400-power lens including 20 by 20, 400 lattices in total, with an optical microscope. The area of each of the visual fields was 225 $\mu m^2$. The number of σ phases existing on the lattice points in each of the visual fields was counted. The value obtained by dividing the total number of counts of σ phases by the total number of lattice points (2400 points) of the six visual fields was determined as the area fraction of the σ phase (in %).

[Microscope Test of Grain Size]

Specimens were extracted from the produced steel plates of the respective marks. With use of the specimens, a microscope test of the grain size in conformity with JIS G0551 (2005) was carried out, and the grain size numbers of the austenitic crystal grains of the respective marks were found.

[High Temperature Strength Test]

From the produced steel plates of the respective marks, round bar specimens each with the outside diameter of the parallel part of 6 mm were extracted. With use of the extracted round bar specimens, a high temperature tension test in conformity with JIS G0567 (1998) was carried out to find yield strength (MPa) of each of the marks. The test temperature was 230° C. Further, 0.2% yield stress was defined as the yield strength.

[65% Nitric Acid Corrosion Test]

A 65% nitric acid corrosion test (Huey test) in conformity with JIS G0573 (1999) was carried out, and the nitric acid corrosion resistance of the steel plate of each of the marks was examined. More specifically, from the steel plate of each of the marks, a specimen of 40 mm×10 mm×2 mm was extracted. The surface area of the specimen was 1000 $mm^2$. Further, a test solution with the concentration of nitric acid being 65 mass % was prepared. The specimens were immersed in the boiled test solution for 48 hours (the first immersion test). After the test ended, a new test solution was prepared, and the second immersion test was carried out. More specifically, the specimens were taken out from the test solution that was used in the first immersion test, and the specimens were immersed in the test solution for the second immersion test for 48 hours. The immersion tests as above were repeatedly performed five times (the first test to the fifth test).

Before and after the respective immersion tests (the first test to the fifth test), the masses of the specimens were measured, and the differences (mass losses) were found. Based on the mass losses, for each of the immersion tests, the mass losses per unit area and unit time of the specimens (hereinafter, called unit mass losses, in $g/m^2/h$) were found. The average value of the unit mass losses of the five tests (the first test to the fifth test) that were found was defined as a corrosion rate ($g/m^2/h$).

[Test Result]

The test result is shown in Table 2.

TABLE 2

| Mark | Sigma phase area fraction (%) | Grain size number | High temperature strength (MPa) | Corrosion rate ($g/m^2/h$) |
|---|---|---|---|---|
| 1 | <0.01 | 6.3 | 225 | 0.057 |
| 2 | <0.01 | 6.4 | 242 | 0.056 |
| 3 | <0.01 | 6.9 | 245 | 0.059 |
| 4 | <0.01 | 5.8 | 204 | 0.052 |
| 5 | <0.01 | 6.2 | 203 | 0.057 |
| 6 | <0.01 | 4.6 | 199 | 0.036 |
| 7 | 0.2 | 6.9 | 221 | 0.096 |
| 8 | <0.01 | 6.3 | 201 | 0.091 |
| 9 | <0.01 | 6.7 | 223 | 0.086 |
| 10 | <0.01 | 5.9 | 191 | 0.089 |
| 11 | <0.01 | 7.0 | 239 | 0.101 |
| 12 | 0.4 | 6.7 | 232 | 0.112 |

Referring to Table 2, the chemical compositions of marks 1 to 3 were within the range of the chemical composition of the present invention, and the solution temperatures were within the range of 1050 to 1100° C. Accordingly, the σ phase area fractions of the austenitic stainless steel plates of marks 1 to 3 were at most 0.1%, and the grain size numbers were 6.0 or larger. Therefore, the high temperature strengths of marks 1 to 3 were 220 MPa or more, and the corrosion rates thereof were at most 0.085 $g/m^2/h$.

Meanwhile, the Mn content of mark 4 was less than the lower limit of the Mn content of the present invention, and the solution temperature exceeded 1100° C. Therefore, the grain size number of mark 4 was less than 6.0, and the high temperature strength thereof was less than 220 Mpa.

The Mn content of mark 5 was less than the lower limit of the Mn content of the present invention. Therefore, the high temperature strength of mark 5 was less than 220 MPa.

The chemical composition of mark 6 was within the range of the chemical composition of the present invention, but the solution temperature exceeded 1100° C. Therefore, the grain size number of mark 6 was less than 6.0, and the high temperature strength thereof was less than 220 MPa.

The chemical compositions of marks 7 and 12 were within the range of the chemical composition of the present invention, but the solution temperatures were less than 1050° C. Therefore, the σ phase area fractions exceeded 0.1%. As a result, the corrosion rates exceeded 0.085 $g/m^2/h$.

The Ni content of mark 8 was less than the lower limit of the Ni content of the present invention. Therefore, the high temperature strength was less than 220 MPa, and the corrosion rate exceeded 0.085 $g/m^2/h$.

The Ni content of mark 9 exceeded the upper limit of the Ni content of the present invention. Therefore, the corrosion rate exceeded 0.085 $g/m^2/h$.

The N content of mark 10 was less than the lower limit of the N content of the present invention. Therefore, the grain size number was smaller than 6.0. Accordingly, the high temperature strength was less than 220 MPa, and the corrosion rate exceeded 0.085 $g/m^2/h$.

The N content of mark 11 exceeded the upper limit of the N content of the present invention. Therefore, the corrosion rate exceeded 0.085 $g/m^2/h$.

Note that referring to marks 1 to 3, 7 and 12, the a phase area fractions significantly declined as the solution temperature increased. When the solution temperatures were 1050° C. or higher, the σ phase area fractions were at most 0.1%.

The embodiment of the present invention is described above, and the aforementioned embodiment is only an illustration for carrying out the present invention. Accordingly, the present invention is not limited to the aforementioned embodiment, and the aforementioned embodiment can be carried out by being properly modified within the range without departing from the gist of the present invention.

INDUSTRIAL APPLICABILITY

The present invention can be widely applied to the steel materials that are required to have high temperature strength and nitric acid corrosion resistance, and can be applied to, for example, steel materials for chemical plants. The present invention is especially preferable for the steel materials for urea plants.

The invention claimed is:

1. Austenitic stainless steel comprising: in mass percent,
C: at most 0.050%;
Si: 0.01 to 1.00%;
Mn: 1.75 to 2.50%;
P: at most 0.050%;
S: at most 0.0100%;
Ni: 20.00 to 24.00%;
Cr: 23.00 to 27.00%;
Mo: 1.80 to 3.20%; and
N: 0.130 to 0.180%,
the balance being Fe and impurities,
wherein a grain size number of crystal grains based on JIS G0551 (2005) is at least 6.0, and
an area fraction of a σ phase is at most 0.1%, and
wherein yield strength at 230° C. is at least 220 MPa, and a corrosion rate in a 65% nitric acid corrosion test in conformity with JIS G0573 (1999) is at most 0.085 $g/m^2/h$.

2. The austenitic stainless steel according to claim 1, further comprising:
in place of some of the Fe,
at least one type selected from a group consisting of
Ca: at most 0.0100%;
Mg: at most 0.0100%; and
rare earth metal (REM): at most 0.200%.

* * * * *